US008373346B2

(12) United States Patent
Hoogzaad et al.

(10) Patent No.: US 8,373,346 B2
(45) Date of Patent: Feb. 12, 2013

(54) SOLID STATE LIGHTING SYSTEM AND A DRIVER INTEGRATED CIRCUIT FOR DRIVING LIGHT EMITTING SEMICONDUCTOR DEVICES

(75) Inventors: Gian Hoogzaad, Mook (NL); Franciscus A. C. M. Schoofs, Valkenswaard (NL)

(73) Assignee: NXP B.V., Eindhoven (NL)

( * ) Notice: Subject to any disclaimer, the term of this patent is extended or adjusted under 35 U.S.C. 154(b) by 392 days.

(21) Appl. No.: 12/672,012

(22) PCT Filed: Jul. 30, 2008

(86) PCT No.: PCT/IB2008/053058

§ 371 (c)(1), (2), (4) Date: Feb. 3, 2010

(87) PCT Pub. No.: WO2009/019634

PCT Pub. Date: Feb. 12, 2009

(65) Prior Publication Data

US 2011/0062889 A1 Mar. 17, 2011

(30) Foreign Application Priority Data

Aug. 6, 2007 (EP) ..... 07113876

(51) Int. Cl.
*H05B 37/00* (2006.01)

(52) U.S. Cl. ..... 315/185 R; 315/193; 315/308

(58) Field of Classification Search ..... 315/291, 315/307, 308, 185 R, 193, 186
See application file for complete search history.

(56) References Cited

U.S. PATENT DOCUMENTS

| | | | | |
|---|---|---|---|---|
| 5,424,624 | A | 6/1995 | Senak, Jr. | |
| 5,548,196 | A | 8/1996 | Lim | |
| 2004/0124716 | A1 | 7/2004 | Shirato | |
| 2006/0033442 | A1 * | 2/2006 | D'Angelo | 315/86 |
| 2007/0216317 | A1 * | 9/2007 | Schindler | 315/185 S |

FOREIGN PATENT DOCUMENTS

| | | | |
|---|---|---|---|
| DE | 3642251 | A1 | 7/1987 |
| EP | 0178615 | A | 4/1986 |
| EP | 0427594 | A | 5/1991 |
| EP | 0902527 | A | 3/1999 |
| WO | 2007/069200 | A | 6/2007 |

* cited by examiner

*Primary Examiner* — David H Vu

(57) ABSTRACT

The present invention relates to a solid state lighting system comprising at least one light emitting semiconductor device, at least one driver for driving a predetermined current through the at least one light emitting semiconductor device. The lighting system furthermore comprises a first voltage supplying unit coupled to provide a first supply voltage to a first side of the at least one light emitting semiconductor device, and a second voltage supplying unit coupled to provide a second supply voltage for the at least one light emitting semiconductor device. The first and the second supply voltages are selected to optimize the voltage drop across the at least one light emitting semiconductor device.

20 Claims, 14 Drawing Sheets

SOLID STATE LIGHTING SYSTEM AND A DRIVER INTEGRATED CIRCUIT FOR DRIVING LIGHT EMITTING SEMICONDUCTOR DEVICES

FIELD OF THE INVENTION

The present invention relates to a solid state lighting system and a driver-integrated circuit for driving light emitting semiconductor devices.

BACKGROUND OF THE INVENTION

Light emitting semiconductor devices play an important role in today's lighting systems. Applications for light emitting semiconductor devices, such as light emitting diodes (LEDs) include general illumination, automotive and consumer applications. Today's technologies provide a wall-plug power efficiency of about 15%-20%, which is projected to increase up to 30% and more. Cold cathode fluorescent lamps (CCFL) being generally used in liquid crystal display (LCD) backlighting applications for notebooks, monitors, or television provide a power efficiency of about 15%. A power efficiency of about 30% pushes light emitting diodes on the same level as high frequency tubular lamps (HF-TL) being used for general illumination applications (e.g. home, office, factory, etc.).

FIG. 1 shows a simplified block diagram of a driving configuration for light emitting diodes according to the prior art. The power supply PS provides a supply voltage on a power line Vbus being coupled to a string of light emitting diodes LEDstr. The current ILED through the string of light emitting diodes LEDstr is determined by the LED driver LEDdr. The current ILED may be delivered by a linear or a switch mode regulated driver. For switch mode regulated drivers, the driver configuration can be of any kind, such as inductive buck, boost, buck-boost, and capacitive up, down, up-down topologies, or the like. A string of LEDs having one LED driver LEDdr, but multiple parallel LED strings LEDstr including LED driver LEDdr may also be used.

FIG. 2 shows a simplified block diagram of a configuration according to the prior art having two strings of LEDs LEDstr and a driver LEDdr for each of the strings. Generally, for the configurations shown in FIG. 1 and FIG. 2, the current through the strings of LEDs is the critical parameter as this current ILED determines luminance, color, brightness etc. of the light emitting diodes. The drivers LEDdr of FIG. 1 and FIG. 2 may provide direct connections to the power supply block, which are omitted for simplicity of the figures.

FIG. 3 shows simplified representations of the basic driver topologies for driving light emitting semiconductor devices according to the prior art. FIG. 3 (*a*) shows the linear driver configuration having a power supply PS that provides the supply voltage Vbus to the string of LEDs LEDstr and a current source CS, which determines the current ILED through the string of LEDs. FIG. 3 (*b*) shows a simplified schematic of the switch mode buck configuration of a driver. The switch SW is controlled to switch the current through the inductor L and the string of LEDs LEDstr such that an average current of ILED through the string of LEDs LEDstr is provided. The capacitor C functions as a buffer capacitor, and the diode D allows a current to circle through the string of LEDs LEDstr, the inductor L, and the diode D, if the switch SW is turned off. FIG. 3 (*c*) shows a switch mode boost configuration of a driver circuit. Accordingly, the switch SW provides a current path from power supply PS through inductor L to ground. If the switch SW is turned off, the current of inductor L continues via diode D and LED string LEDstr. FIG. 3 (*d*) shows a buck-boost switch mode buck-boost configuration. Accordingly, a current path is provided through the inductor L and the switch SW, if the switch is turned on. Once the switch SW is turned off, the current circles via diode D and LED string LEDstr and is driven by inductor L. Generally, a capacitor in parallel to the LED strings LEDstr can always be present to filter the LED current. Usually, the capacitor is used, when the current (typically from the coil) is not continuously flowing in the LED string LEDstr. This depends on the used driver topologies (e.g. boost and buck-boost driver topologies). The switches SW can be of n and p type. It is most convenient to use n type switches in the configurations shown in FIG. 3.

FIG. 4 shows a simplified block diagram of an electronic system according to the prior art. In particular, a solid state lighting system is depicted. The system can for example be implemented as a scanning backlight system with eight chains of 64 LEDs each. For illustrative purposes, only three chains of LEDs LEDstr are depicted in FIG. 4. An inductor L and a switch T are arranged in series with each chain of LEDs. Fly-back diodes D are coupled in parallel to the string of LEDs LEDstr. A typical LED string voltage is e.g. ranging from 173V to 237V, denoted in the following as 173V-237V. The breakdown voltage of the switches T and the fly-back diodes D should be at least the driving voltage Vbus1. If the driving voltage Vbus1=300V, then the voltage across the inductor L is either 173V-237V or 127V-63V in dependence on the switch condition of the transistors. It should be noted that the transistor, the inductor and the fly-back diode can be represented by a three terminal converter block. In the arrangement according to FIG. 4, the required breakdown voltage of the transistors T and the fly-back diodes will be 300V.

In other words, a typical architecture of circuits for driving one or more light emitting diodes includes a supply voltage applied across a string of LEDs coupled in series, and a current source or sink coupled to one side determining the current flowing through the string. The voltage drop across the string of LEDs and the voltage drop across the current source add up to the total supply voltage. Accordingly, if the voltage across the LEDs varies due to variations of the forward voltages of each LED which may be a consequence of temperature, aging or production spread, the voltage across the current source, (i.e. the driving means) may increase or decrease accordingly. If the voltage across the driving means is greater than necessary, a substantial loss of power occurs which is turned into heat. A second undesired effect of high voltages in the current sources or sinks resides in the need for components being suitable to withstand high voltages, temperatures or the like, which are a consequence of improperly adjusted voltages across the components.

SUMMARY OF THE INVENTION

It is an object of the present invention to provide a solid state lighting system that uses drivers with lower voltage ratings that are cheaper and also allow for higher switching frequencies to be used.

This object is solved by a solid state lighting system, by a driver-integrated circuit and a method of driving light emitting devices.

Therefore, a solid state lighting system is provided which comprises a string with at least one light emitting semiconductor device and a driving means for driving the string with the light emitting semiconductor device. Further, a first voltage supplying unit provides a first supply voltage for driving the string of light emitting semiconductor devices and a second voltage supplying unit provides a second supply voltage for driving the string of light emitting semiconductor devices. The first and second voltage supplying units are arranged so as that a voltage drop across the driving means is tunable by selection of the first and second supply voltage.

Accordingly, such a solid state system serves to overcome the drawbacks of the typical architectures of circuits for driving the string of one or more light emitting diodes or devices based on only a single voltage supply. The potentials provided by the two power supplies may have a positive or negative sign and any potential in the system may be defined as ground. If more than a single voltage supply is used for an LED, or a string of LEDs coupled in series, undesired power losses can be avoided. Further, the requirements for the electronic components may be reduced, if the voltage drop across the components, i.e. the driver's circuit, becomes smaller. Therefore, the driver can be designed to operate at a reduced voltage, which can be much lower than the voltages across the LEDs. This is advantageous as more than one LED can be driven by the driver.

Accordingly, by coupling a second supply voltage (in addition to a first supply voltage) to the driver circuit, the voltage across the driver circuit is reduced. The voltages across the driving circuit and the light emitting device can thus be adjusted in a more appropriate manner than by single supply solutions. The additional degree of freedom provided by the second power supply, allows a lower breakdown voltage rating for the power devices. The first supply voltage may be controlled to a minimum, which is determined by voltages required by the string of one or more light emitting devices having the highest forward voltage. If variations of the forward voltages of each LED of a string occur which may be a consequence of temperature, aging or production spread, the present invention is further capable of adjusting the voltages across the LEDs appropriately in order to compensate the negative effects. Substantial losses of power produced by heat in the electronic components may be avoided, if the voltages across the driving means are adjusted to be not greater than necessary.

More specifically, the first and second supply voltages are suitably provided by means of first and second busses, between which the sequence of the driving means and the string extend. Suitably, more than one such sequence is arranged between the busses. In an alternative implementation both busses are coupled to the driving means, whereas the string is present between the driving means and ground. In a further implementation, no busses are present.

The first and second voltage supplying units are suitably power supplies. They may be discrete power supplies, but are alternatively combined into an integrated circuit. In one embodiment, the first voltage supplying unit suitably operates as a power source, while the second voltage supplying unit operates as a power sink. In this case, the driver means preferably comprises a boost converter. In an alternative embodiment, the reverse is arranged, and the second voltage supplying unit acts as power source. Then the driver means suitably includes a buck converter.

As will be clear from this, the driver means suitably includes a converter, and more particularly a switch mode converter. For reasons of clarity, it is observed that this driving means for providing a current is also referred to as a current source. This current source preferably has a first, a second and a third terminal. The first terminal is coupled to the string. The second terminal is coupled to the second voltage supplying unit, c.q. the corresponding bus. The third terminal is coupled to ground. Alternatively, if the string is coupled to ground instead of to the first voltage supplying unit, the third terminal will be coupled to the first voltage supplying unit, c.q. the first bus.

In one alternative embodiment, the driving means comprises a linear regulator. This is particularly interesting if the second voltage supplying unit is locally present. It is for instance a battery or a solar cell. This implementation enables a larger freedom to select the first supply voltage.

In a further embodiment, an additional power converter is present between the first and the second voltage supplying unit, c.q. first and second busses. Herewith the supply voltages are coupled to each other. Therewith, the voltage requirements for many driving means for strings can be reduced. Such an additional power converter may be a capacitive converter or an inductive converter. The capacitive converter particularly operates as a voltage halver/voltage doubler.

According to another aspect of the invention, at least one dim transistor unit is provided, which is coupled in series with the light emitting semiconductor device.

The invention also relates to a driver integrated circuit comprising a driving means for driving light emitting semiconductor device. Further, a first voltage supplying unit provides a first supply voltage for driving the light emitting semiconductor device and a second voltage supplying unit provides a second supply voltage for driving the light emitting semiconductor device. The first and second supply voltages are selected to optimize a voltage drop across the driving means.

The invention further relates to a method for driving at least one light emitting device. A predetermined current is driven through the at least one light emitting semiconductor device. A first supply voltage is provided to a first side of the at least one light emitting semiconductor device. A second supply voltage is provided to the at least one light emitting semiconductor device. The first and second supply voltages are selected such that the voltage drop across the driver means is optimized.

BRIEF DESCRIPTION OF THE DRAWINGS

These and other aspects of the invention will be apparent from and elucidated with reference to the embodiments described hereinafter. In the following drawings

DETAILED DESCRIPTION OF EMBODIMENTS

In the following, the embodiments of the invention are described in more detail. The terms "power supply" and "ground" are used as one option. It is to be understood that the supply potentials can have positive and negative signs and that any point in the following systems can be at ground level. The diodes D may also be implemented as a second switch, which enables synchronous rectification. The current ILED is determined and controlled by several different means. For example, a sense resistor in series with the LED strings LEDstr. Furthermore, a feedback mechanism, feeding this signal back to a control circuit driving the current source (linear driver) or determining the duty cycle of the control switch SW (switch mode solutions) may be used. Pulse width modulation (PWM) dimming may also be implemented by turning on and off the current source (linear or switched mode), but also by means of adding an extra dim switch or transistor unit that either is put in series or parallel with the LED string LEDstr. The power supply source PS being used to generate the supply voltage Vbus may also be of any type. It should be mentioned that all these variations do not basically impact the topology.

Figure 5:
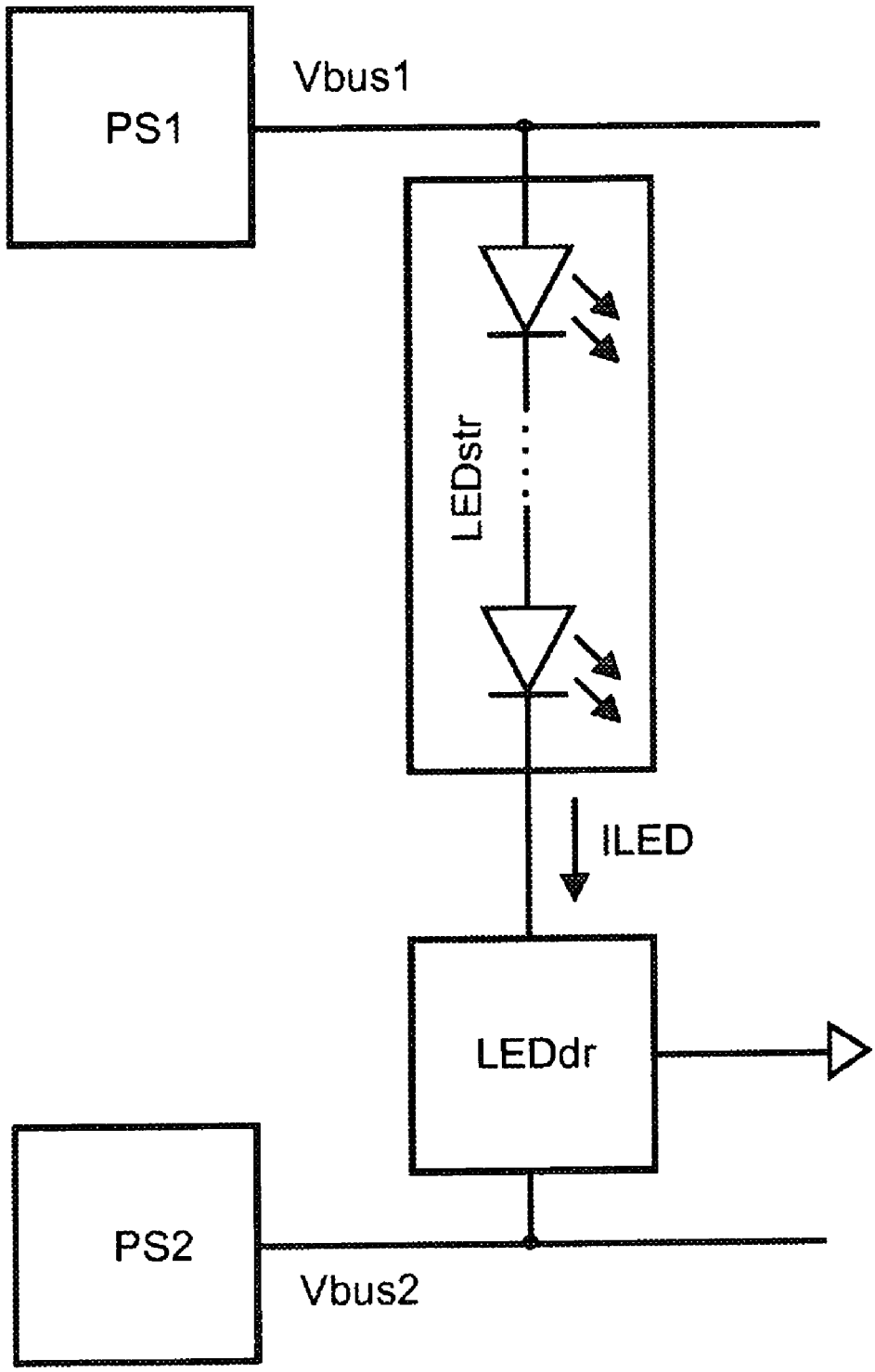
FIG. 5 shows a simplified block diagram of an electronic system according to a first embodiment.

FIG. 5 shows a simplified block diagram of an electronic system, in particular a solid state lighting system, according to a first embodiment of the present invention. The solid state lighting system comprises a first and second power supply PS1, PS2 for providing a first and second supply voltage $V_{bus1}$, $V_{bus2}$. The block LEDdr may have a third terminal involved with the power distribution, here indicated as ground, that carries the current ILED during part of the time. The lighting system furthermore comprises a string of light emitting diodes LEDstr and a driver circuit LEDdr for driving the string of LEDs. Accordingly, the first and second power supplies PS1, PS2 are coupled to the string of light emitting diodes LEDstr. The two power supplies PS1, PS2 provide two potential Vbus1 and Vbus2, and they may be of any type, linear, inductive, or capacitive switch mode, battery, solar cell, fuel cell, etc., or, they even may share parts in common with the LEDdr circuitry. If the power supplies and the two supply voltages Vbus1 and Vbus2 are e.g. provided on both ends of the string of light emitting semiconductor devices and the LED driver is implemented with common transistor circuits i.e. without switched-mode power converters, the string maximally only experiences the difference voltage Vbus1−Vbus2. If properly adjusted, this may result in a small dissipation in the driver circuit LEDdr. The voltage Vbus2 can be dimensioned such that less power is delivered to the other system components connected to its terminals, i.e. like the driver circuit LEDdr. The driver circuit can be coupled between the second supply voltage $V_{bus2}$ and the string of LEDs. The driver circuit LEDdr is also coupled to a ground node such that the ground node as well as the output to the second supply voltage $V_{bus2}$ each carries a part of the LED current ILED.

Figure 6:
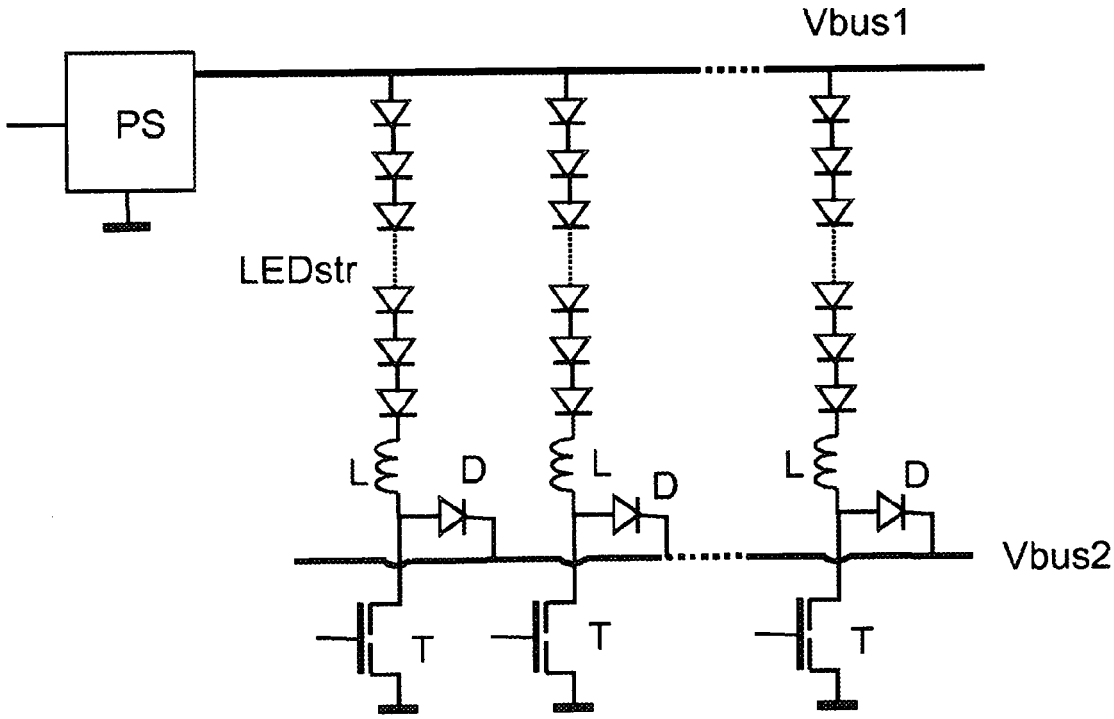
FIG. 6 shows a simplified schematic of a lighting system according to a second embodiment of the invention.

FIG. 6 shows a simplified schematic of a second embodiment of the invention. A power supply PS is provided which is used to obtain a first supply voltage Vbus1. A plurality of strings of LEDs is coupled to the first supply voltage Vbus1. In series with each string of LEDs, an inductor L and a switch T (which can be implemented as a transistor) is provided. In addition to the first supply voltage Vbus1, a second supply voltage Vbus2 is provided. A diode D is coupled between the inductor and the second supply voltage Vbus2.

It should be noted that each driving unit or each string of LEDs comprises an associated transistor T, inductor L and a fly-back diode D. Thus, the driver unit constitutes a three terminal unit. As an illustrative example, the voltage of the first supply voltage Vbus1 corresponds to 300V and the voltage across the strings of LEDs corresponds to VLED chain=173V−237V. Therefore, the second supply voltage Vbus2 must be >127V, as the difference between the first and second supply voltage Vbus1-Vbus2<VLEDmin. In other words, if the second supply voltage is >127V, then the difference between the first and second supply voltage, i.e. the voltage applied to the driver units, is smaller than the minimum VLED voltage. According to the second embodiment, the energy flow through the fly-back diodes D is towards the second supply voltage Vbus2. Therefore, care should be taken that the second supply voltage Vbus2 is able to accommodate or absorb the energy flowing towards it. As an example, this can be performed if a boost converter is implemented in the driver unit. Such a boost converter must be able to carry the excess energy from the second supply voltage Vbus2 to the first supply voltage Vbus1. On the other hand, if the energy flow is out of the second supply voltage Vbus2, then the driver unit should comprise a buck converter between the first and second supply voltage Vbus1, Vbus2.

If for example the second supply voltage is set to approx. 150V, then a capacitive converter like a voltage halver/voltage doubler can be provided between the first and second supply voltages. With such a capacitive converter, it can be ensured that energy can be carried in the direction of the first or the second supply voltage. If the second supply voltage is set 150V, then the required breakdown voltages of the transistors and the fly-back diodes must be only 150V.

Figure 7:
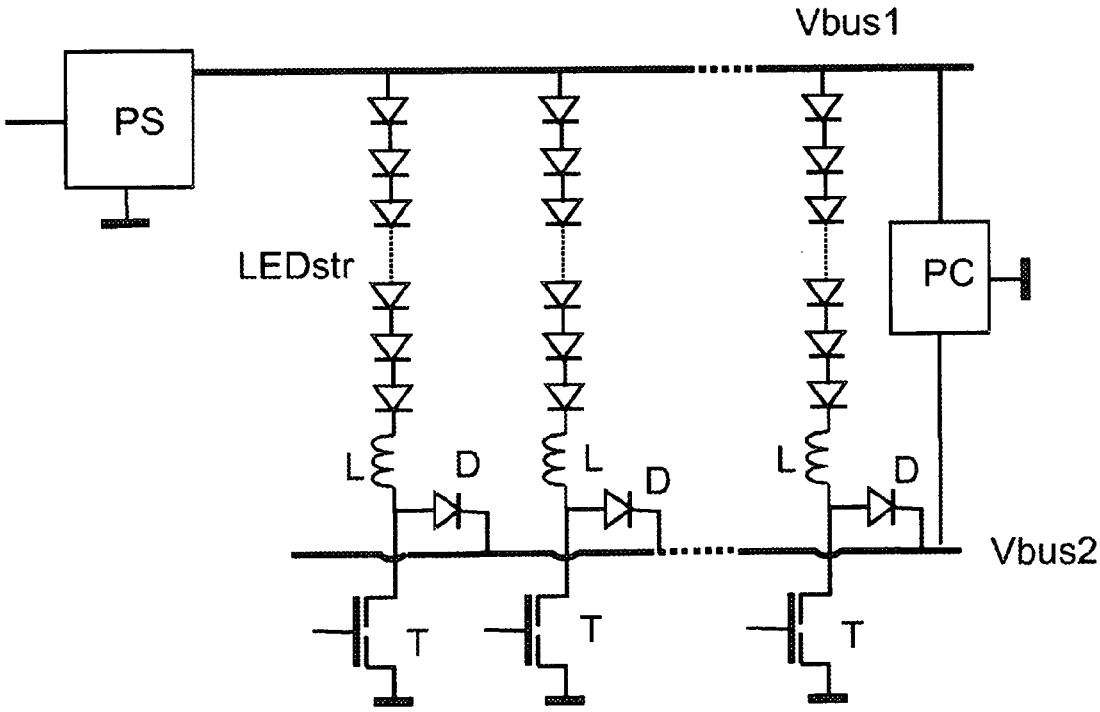
FIG. 7 shows a simplified schematic of a lighting system according to a third embodiment of the invention.

FIG. 7 shows a schematic of an electronic system, in particular a solid state lighting system according to a third embodiment. The solid state system according to the second embodiment substantially corresponds to the solid state lighting system according to the second embodiment with an additional power converter coupled between the first and second supply voltage Vbus1; Vbus2. The power converter PC can be implemented as an inductive or capacitive converter. By the provision of a second supply voltage and by the provision of a power converter according to the third embodiment, the voltage requirements for many driver units for LED chains can be reduced. The converter coupled between the first and second supply voltages does not need to be optimized for specific LED properties. The voltage across the inductor L is either 127V-63V or 87V-23V depending on the transistor (switch) condition (for Vbus1=300V, Vbus2=150V, and VLED chain=173V−237V). It should be noted that the voltage across the inductor is therefore less than according to the prior art. If the current ripple and switching frequency remains the same, the inductance value can be lower in an arrangement according to the second and third embodiment. It should be further noted that in accordance with specific applications, the voltage ratio between the configuration according to the second and third embodiment and the prior art configuration can be more advantageous.

According to the second and third embodiment, a driving unit with three supply terminals can be provided in which all three currents from the LED are flowing.

Figure 8:
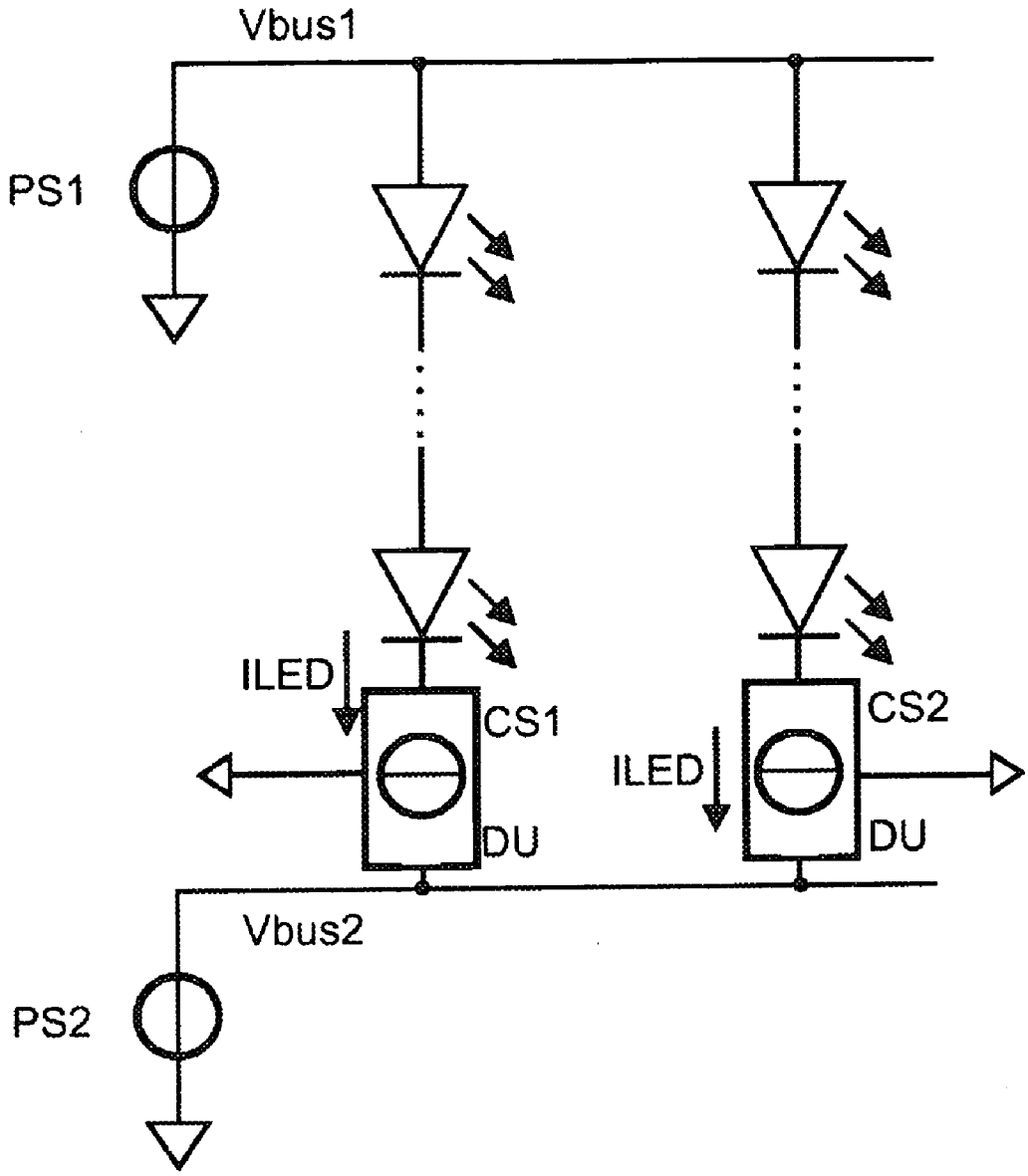
FIG. 8 shows a simplified representation of an electronic system of a fourth embodiment.

FIG. 8 shows a simplified schematic of a lighting system according to a fourth embodiment of the present invention with LED drivers DU. The lighting system comprises a first and second supply voltage Vbus1 and Vbus2, at least a first and second string of LEDs and a first and second driving unit DU with a first and second current source CS1, CS2. Although only two strings of LEDS are depicted it should be noted that more strings and drivers may be attached to Vbus1, Vbus2 and ground. Each of the indicated strings of LEDs have an associated current source functionality CS1, CS2 being used as current driver for each of the strings, respectively. The driving units are implemented as 3-terminal units (Vbus1, Vbus2, ground) and not a 2-terminal unit where the string is only connected between two terminals. The current source or the driving units can be coupled to the second supply voltage $V_{bus2}$ and one of the strings of LEDs. The current source or the driving units may also be coupled to a ground node such that the LED current ILED is carried by the ground node and the second power supply PS2. However, if the voltage difference between Vbus1 and Vbus 2 is chosen appropriately, voltage drop across the current sources may be minimized.

Figure 1:
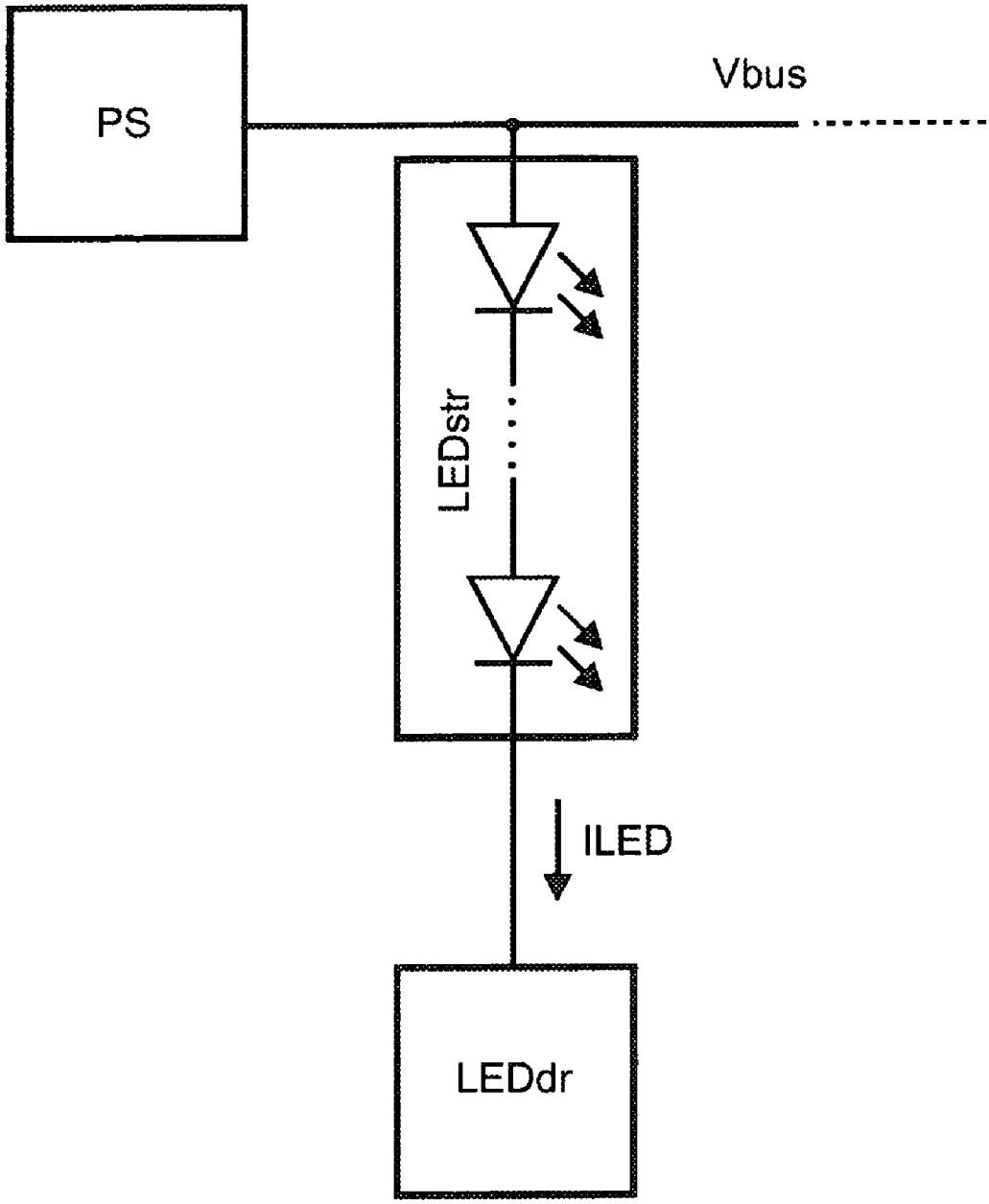
FIG. 1 shows a simplified block diagram of a driver for a light emitting diode according to the prior art.
Figure 2:
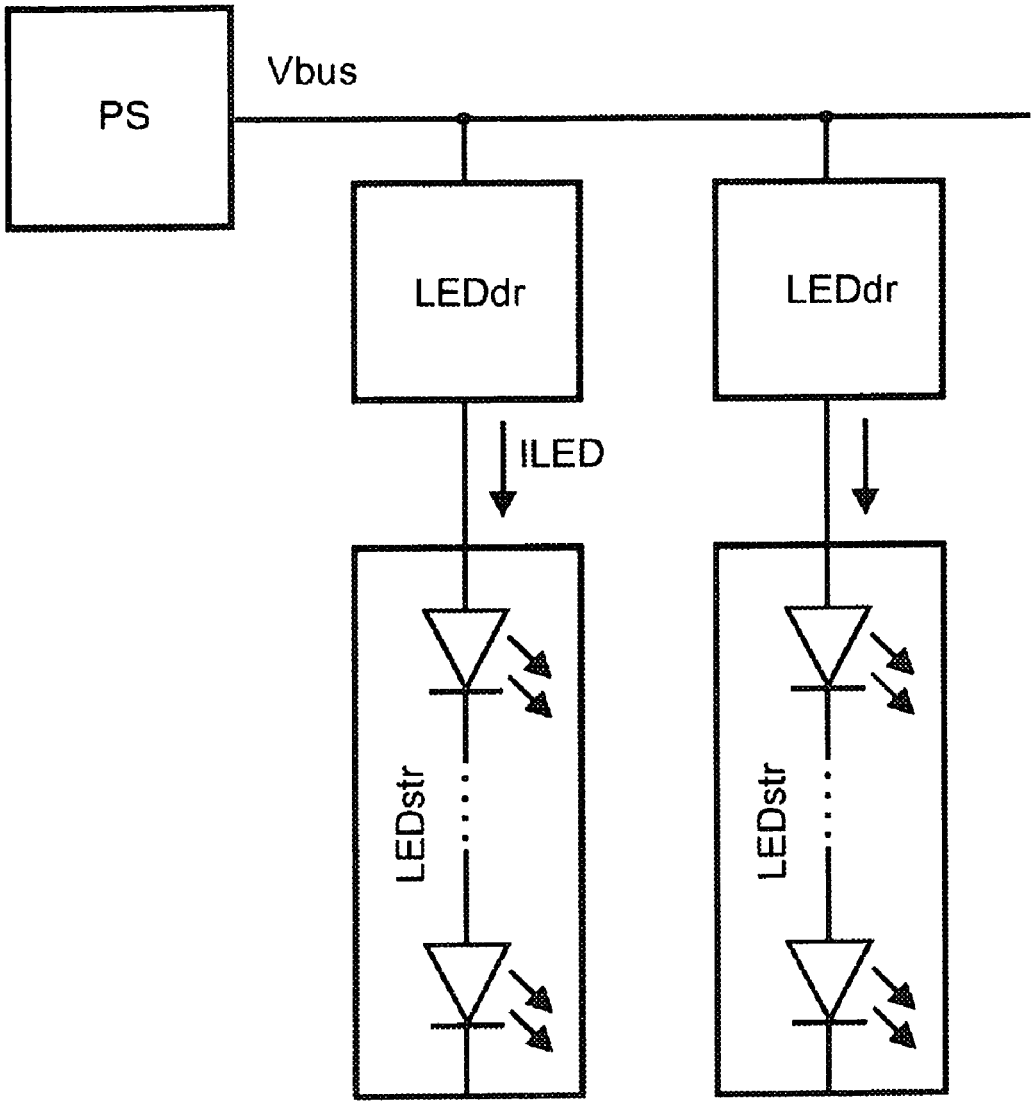
FIG. 2 shows a simplified block diagram of a driver configuration according to the prior art.
Figure 3:
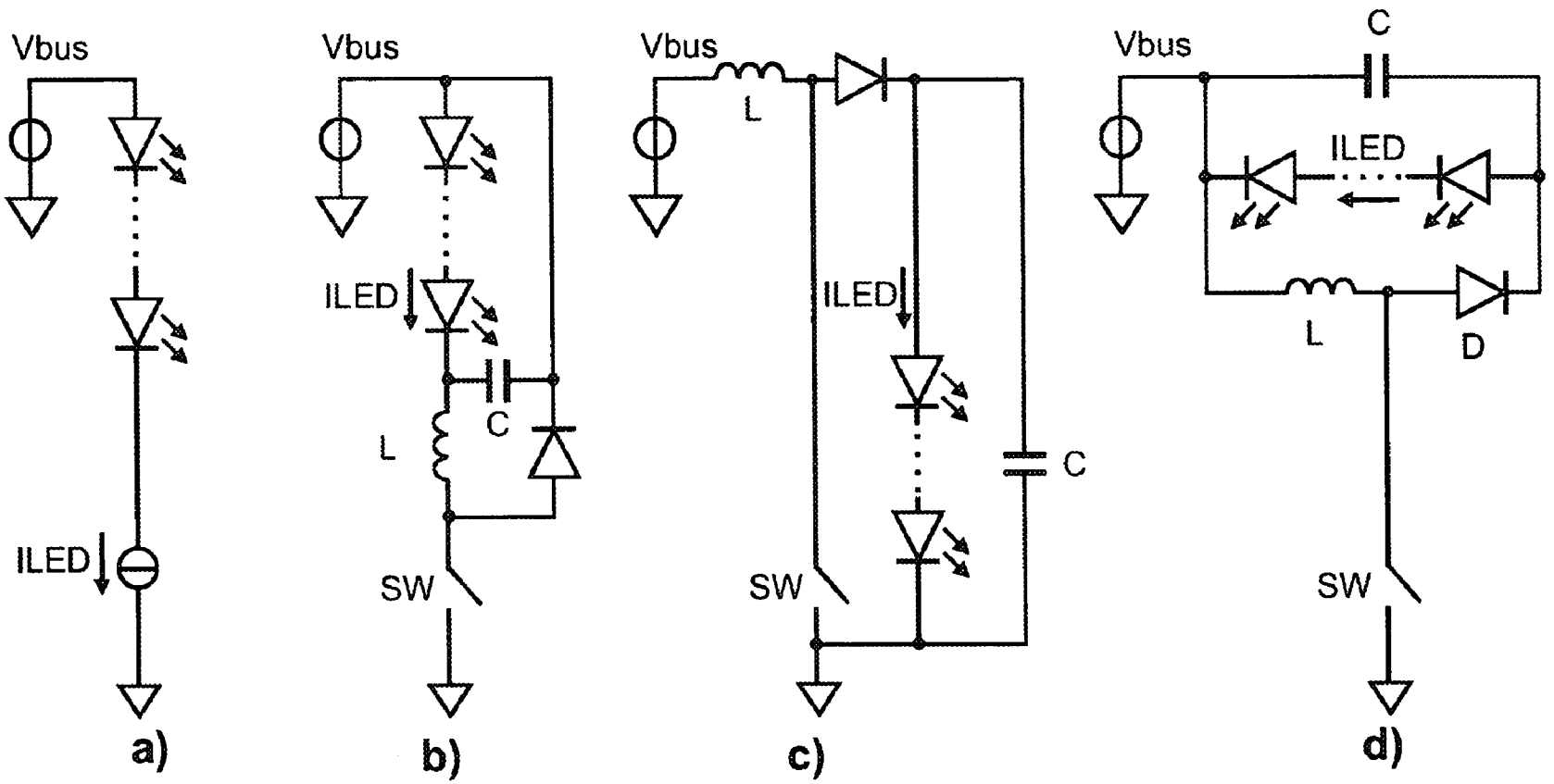
FIG. 3 shows simplified schematics of a linear and three switch mode driver configurations according to the prior art.
Figure 4:
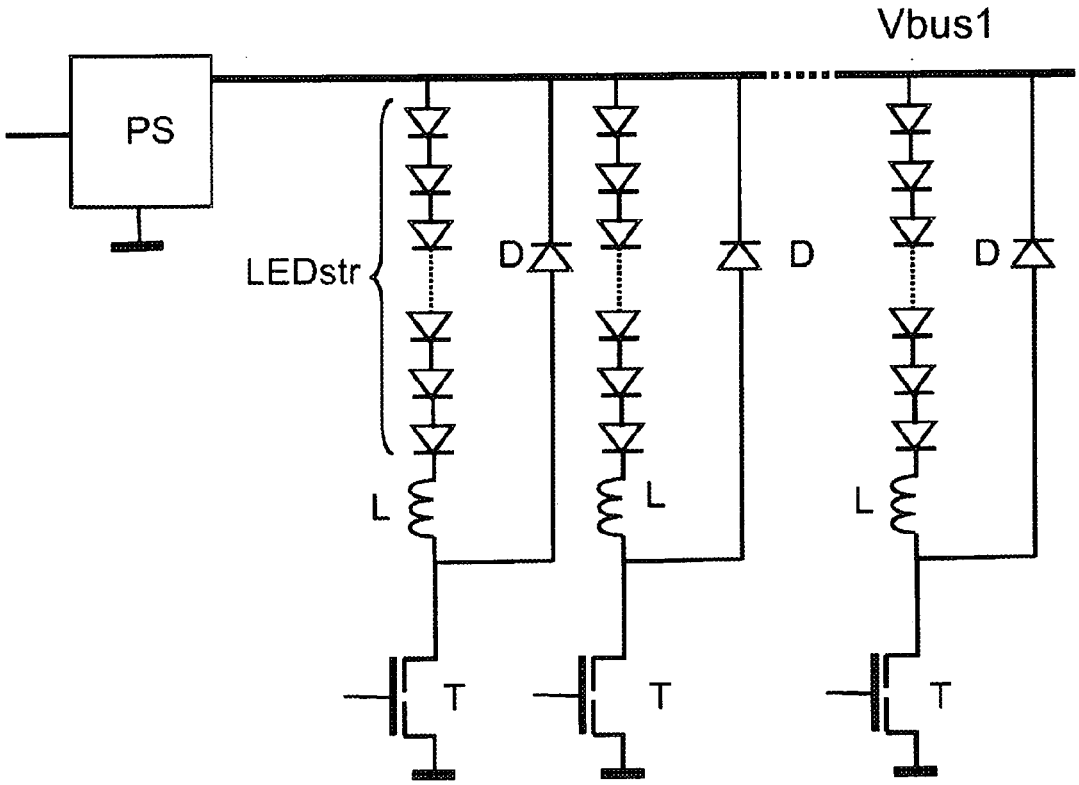
FIG. 4 shows a simplified block diagram of an electronic system of the prior art.
Figure 9:
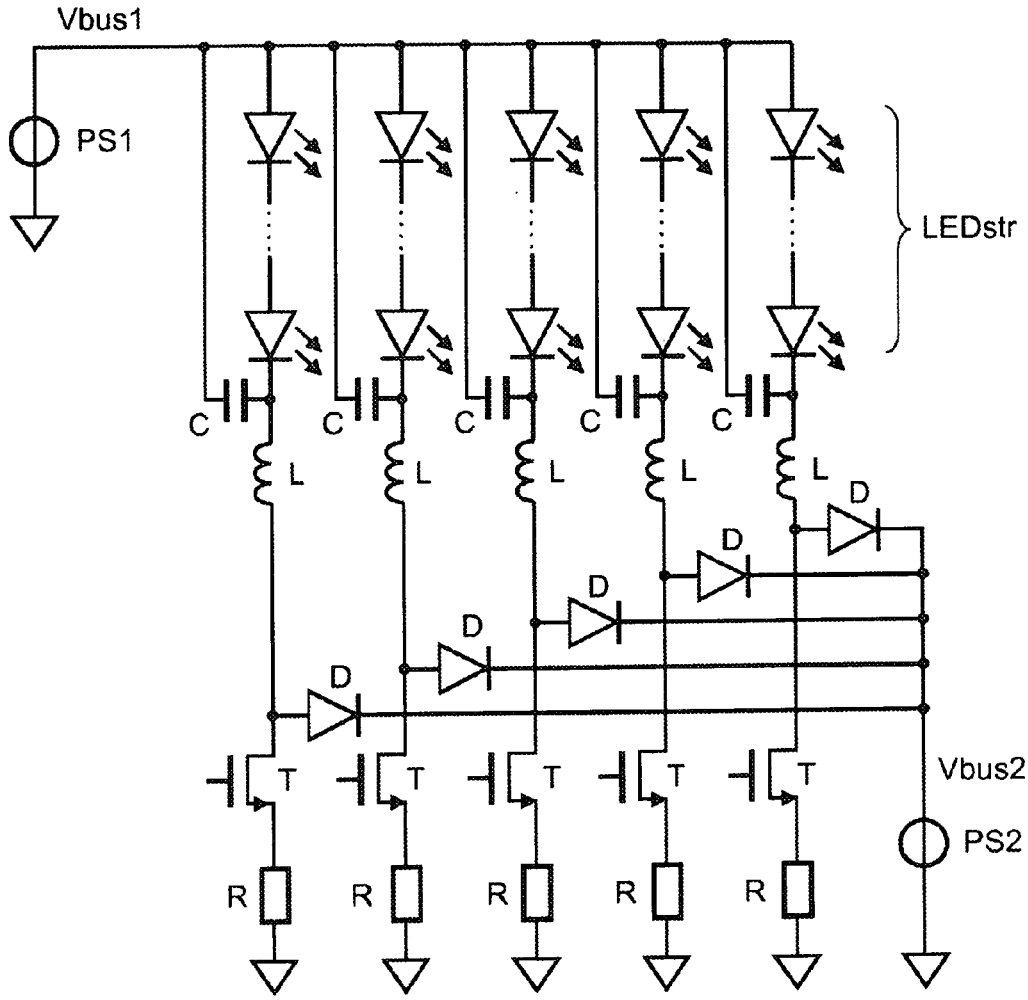
FIG. 9 shows a simplified schematic of a fifth embodiment according to the present invention in a switch mode buck driver configuration.

FIG. 9 shows a simplified schematic of a lighting system of a fifth embodiment according to the present invention. This preferred embodiment relates to a switch mode buck driver configuration. For the general functionality, we refer to FIG. 3 (*b*). According to this embodiment, the power supply PS1 providing the voltage supply Vbus1 is a power source, while power supply PS2 providing the voltage Vbus2 is configured as a power sink. In particular, if Vbus2<<Vbus1, significantly lower voltage requirements are achieved for the driver components. The power sinking capability of PS2 can be provided in various different ways. The voltage Vbus2 may be a voltage being already required in the system. In this situation, the requirements for the power supply PS2 for the voltage level Vbus2 are reduced, since the driver for the light emitting diode supplies power as well to power Vbus2. The resistors R are merely added to illustrate a configuration of a current-mode control of the LED chains LEDstr.

Figure 10:
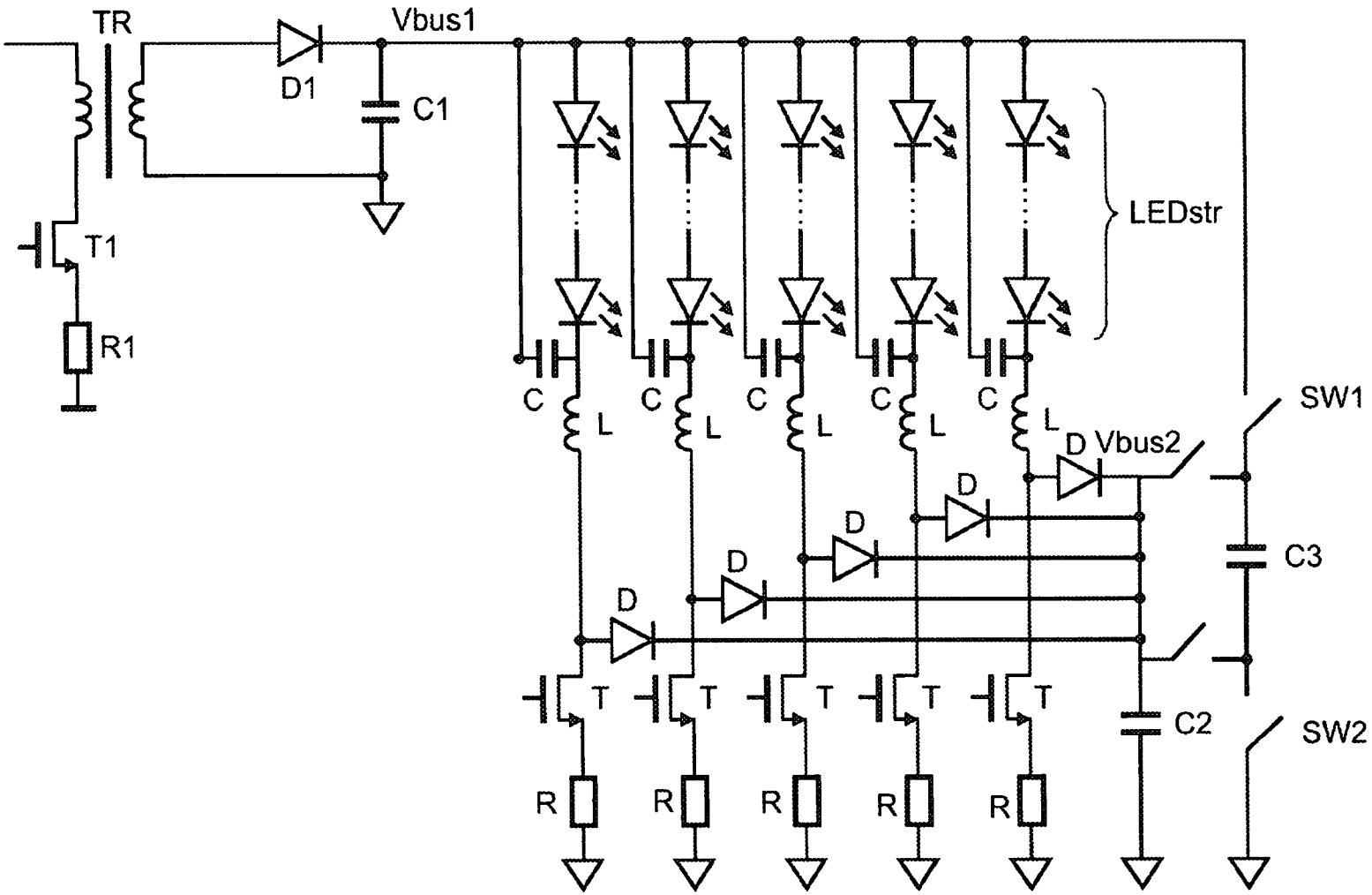
FIG. 10 shows a simplified schematic of an electronic system of a sixth embodiment of the present invention having a flyback converter and buck driver configuration with capacitive voltage converter.

FIG. 10 shows a sixth embodiment according to the present invention, wherein the driving unit or the power converter is configured as a flyback converter with a switch mode buck driver and a capacitive voltage double. This implementation of the present invention includes an efficient power sink capability with a supply voltage Vbus1 reduced by an isolated flyback converter and a supply voltage Vbus2 generated by a capacitive voltage doubler/halver. The voltage requirements of the switches Sw and diodes D in this embodiment are about only half of the requirements according to the prior art. Other conversion ratios for Vbus2/Vbus1 may be achieved, if other capacitive converters are used. For proper operation of the configuration shown in FIG. 10, the voltages are to be chosen to be Vbus2>Vbus1-VLEDs, wherein VLEDs is the voltage drop across the string of LEDs VLEDstr.

Figure 11:
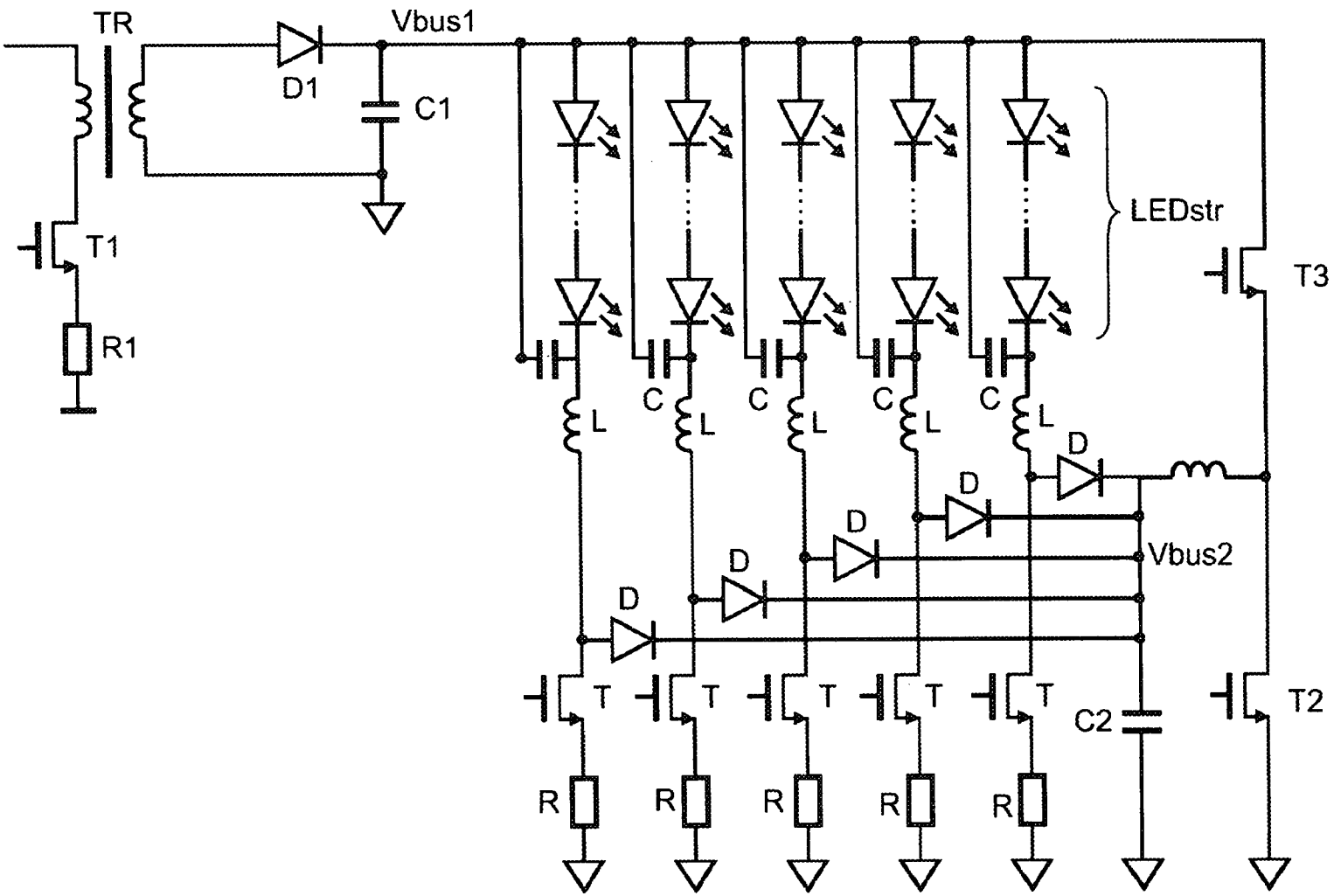
FIG. 11 shows a simplified schematic of an electronic system of a seventh embodiment according to the present invention in a flyback converter and buck driver configuration with inductive boost converter.

FIG. 11 shows a seventh embodiment according to the present invention with a fly-back converter, a switch mode buck driver, and an inductive buck or boost configuration. Accordingly, the node Vbus2 is configured to source and to sink power, such that this supply can easily be used to provide power for other loads. In general, voltages Vbus1 or Vbus2, or both can be supplied or may already be available in this system and may be reused for the purpose according to the present invention. The converters or driving units that drive the LED strings operate at lower voltage than Vbus1 and lower power than the common converters. Accordingly, the individual converters are more suited to be implemented on IC and run at high frequency, while the common higher-power converters may run at lower frequency as required for their power efficiency.

If a linear regulator is used to drive the currents through the light emitting diode strings LEDstr, the value of Vbus is determined within rather strict limits for reasons of dissipation. Providing switch regulators provides a significantly larger degree of freedom of choice for the voltage value of Vbus1. This allows reuse of the power supplies as mentioned above.

According to this configuration, Vbus2 can easily be controlled to any voltage ration Vbus1/Vbus2. Accordingly, not only a fixed voltage ratio as shown and explained with respect to FIG. 7, but a flexible controlled voltage ratio can be achieved. An important, but not limiting control criterion for the supply voltage Vbus2 is the off-state leakage current towards Vbus, when the LED driver LEDdr is turned off, which occurs typically during low frequency PWM dimming. This off-state leakage current determines the available dimming ratio of the drivers, as long as no additional dim switches are used, as for the embodiment shown in FIG. 8. As a consequence, the supply voltage Vbus2 should not have a too low voltage difference relative to the bottom voltages of the LED strings.

The additional degree of freedom relating to the second power supply in the embodiments according to the present invention provides the following advantages. First, there is a lower breakdown voltage rating for the power devices, which relates to switches SW and diodes D, or two switches for synchronous implementations. Further, smaller inductors L may be used with respect to the same conversion frequency and the same ripple. Further, frequency control for boundary-conducting, self-oscillating mode of operation is possible for both by controlling Vbus1 and Vbus2, or each of them separately. An ultimate lowest power device voltage rating and lowest inductance value can be achieved by controlling Vbus1 to minimum determined by the string LEDstr with the highest forward voltage. However, this may require an extra feedback signal from the string LEDstr voltages back to the Vbus1 controller.

Figure 12:
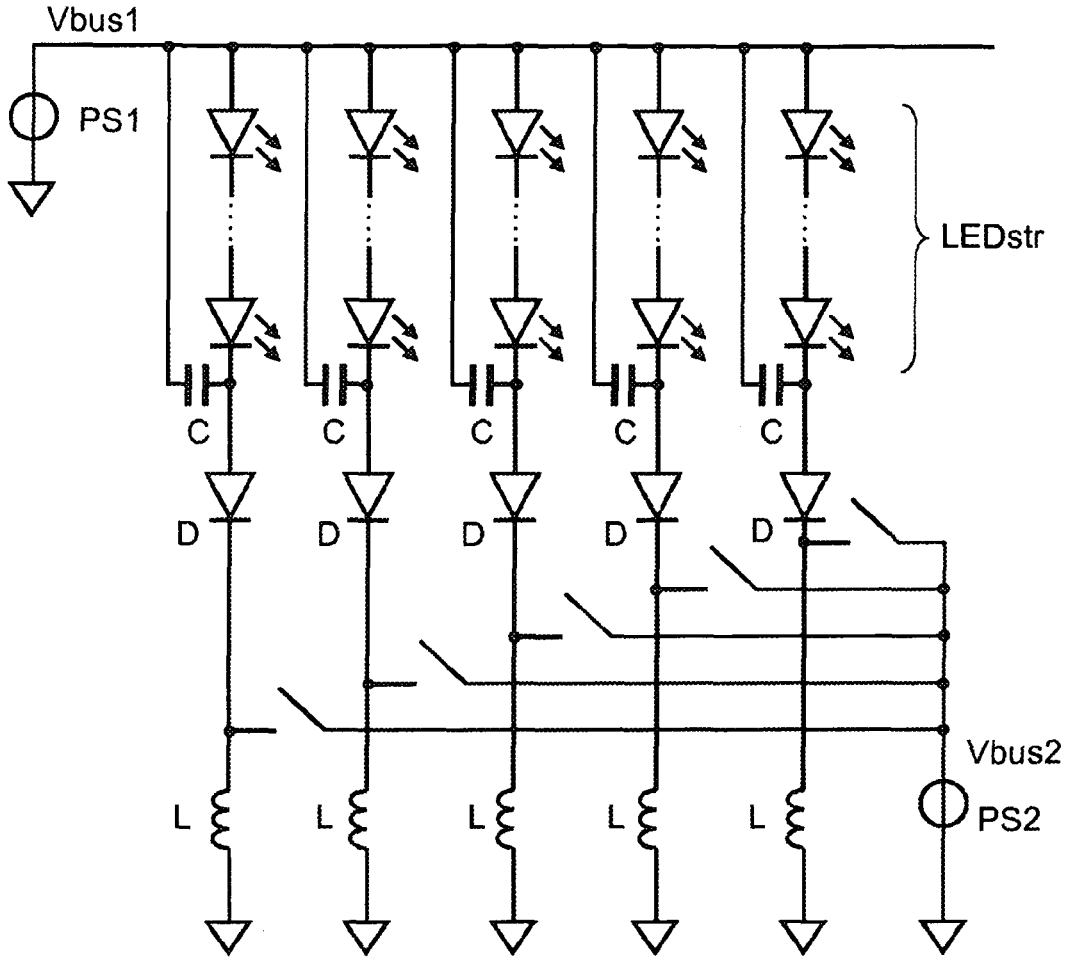
FIG. 12 shows a simplified schematic of an electronic system of an eighth embodiment according to the present invention in a switch mode buck and boost driver configuration.

FIG. 12 shows an eighth embodiment according to the present invention with a switch mode buck/boost driver having two power supplies PS1 and PS2. The voltage levels Vbus1 and Vbus2 are configured as power sources, which may easily be reused when already available in the system. Voltage Vbus1 must be lower than the minimum required value across the light emitting diodes LEDstr. Voltage Vbus2 and the switches SW, the diodes D, and the inductors L form for each string of light emitting diodes LEDstr an inverting buck/boost converter to provide the additional voltage to obtain the maximum required voltage across the strings of LEDs LEDstr. The topology of FIG. 12 is susceptible to changes. For example, the order of functional parts can be changed, i.e. the LEDs can also be connected to ground while inverting buck/boost converters are connected to the high side.

If the values according to the second and third embodiments are used, Vbus1 must be <173V. The second supply voltage Vbus2 may have an 'arbitrary' positive value since it serves to increase the inductor current when the switches are conducting. The voltage at the lowest cathodes of the strings becomes negative in potential. The second supply voltage Vbus2 has to deliver power and Vbus2 may be derived from Vbus1, but it would be more efficient to derive Vbus2 directly from the supply that also supplies the Vbus1 supply. Connecting power converters in series reduces the overall efficiency due to the accumulation of losses of a series converter approach.

Figure 13:
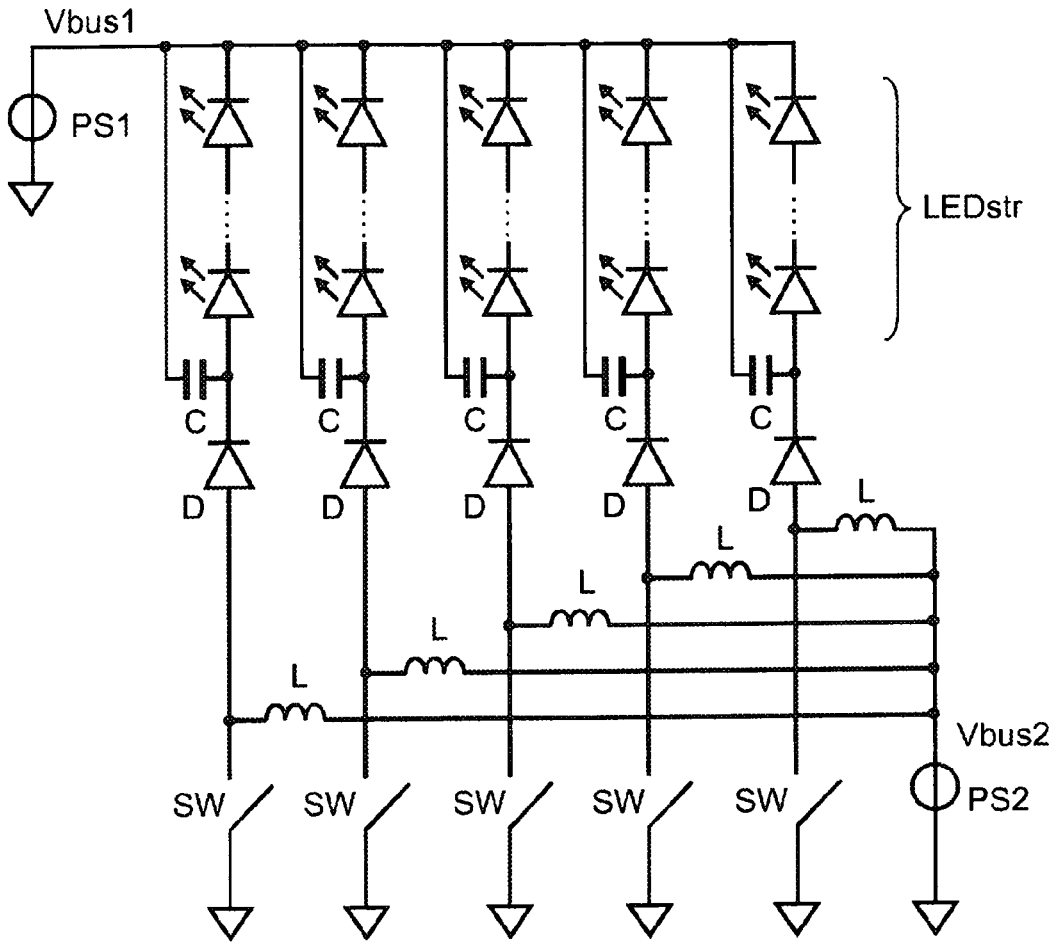
FIG. 13 shows a simplified schematic of an electronic system of a ninth embodiment according to the present invention in a switch mode boost driver configuration.

FIG. 13 is a ninth embodiment according to the present invention with a switch mode boost driver having two power supply sources PS1 and PS2. In this configuration, voltage Vbus2 is provided by a power source PS2 and voltage Vbus1 is provided by power sink PS1. In this configuration, Vbus1 may be chosen smaller or larger than Vbus2.

The converters operate as boost converters and thus the voltage of Vbus1 is not functionally relevant. However, in order to reduce the voltage requirements of the converters, the voltage at Vbus1 should be negative.

Figure 14:
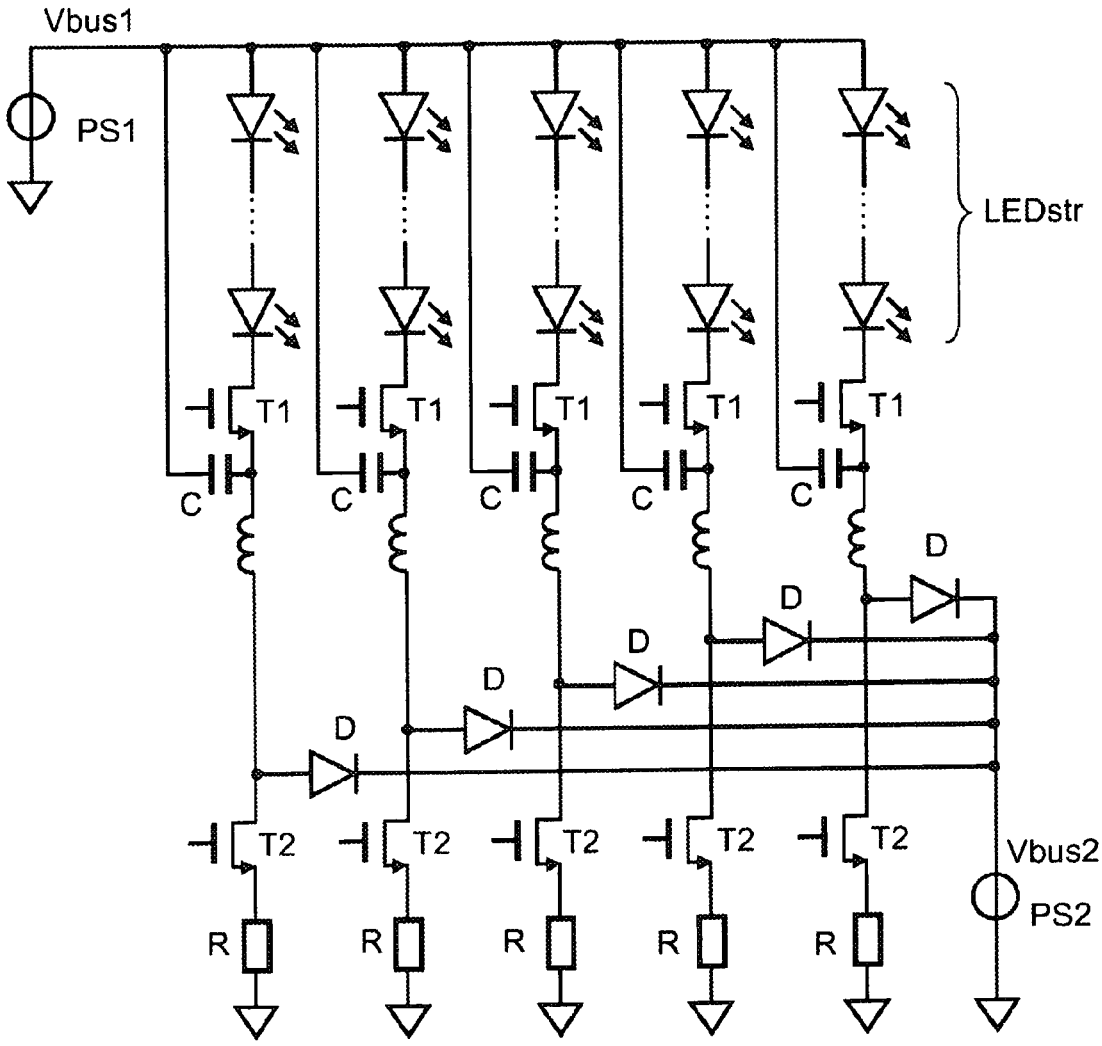
FIG. 14 shows a simplified schematic of an electronic system of a tenth embodiment according to the present invention in a switch mode buck driver configuration with series dim switches.

FIG. 14 shows a simplified schematic of a tenth embodiment according to the present invention for a switch mode buck driver with series dim switches. The transistors T1 are provided in series with the string of LED and can serve to dim the LED if controlled accordingly.

Other applications with strings of separate Red, Green and Blue LEDs, or large ceiling installations with many panels may also be possible based on the principles of the invention. Each panel may then have lower-voltage components and smaller inductors, i.e. the idea offers structural lower cost and opportunities for higher performance.

The principles of the invention may also be implemented in a driver IC for driving light emitting devices, in a backlighting unit e.g. for a LCD application or in a flashlight application.

While the invention has been illustrated and described in detail in the drawings and foregoing description, such illustration and description are to be considered illustrative or exemplary and not restrictive; the invention is not limited to the disclosed embodiments.

Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single . . . or other unit may fulfill the functions of several items recited in the claims. The mere fact that certain measures are recited in mutually different dependent claims does not indicate that a combination of these measured cannot be used to advantage.

Any reference signs in the claims should not be construed as limiting the scope.

The invention claimed is:

1. Solid state lighting system comprising:

a string comprising at least one light emitting semiconductor device, at least one driver for driving a predetermined current through the string, a first voltage supplying unit to provide a first supply voltage unequal to ground for driving the string and a second voltage supplying unit to provide a second supply voltage unequal to ground for driving the string, wherein the first and second voltage supplying units are coupled to the driver in an arrangement, such that a voltage drop across the driver is dependent on the first supply voltage and on the second supply voltage.

2. The lighting system according to claim 1, wherein:

the string is provided with a first terminal and with a second terminal coupled to a first terminal of the driver said driver is provided with a second terminal;

the first terminal of the string is coupled to the first voltage supplying unit, and the second terminal of the said driver is coupled to the second voltage supplying unit.

3. The lighting system according to claim 1, wherein the first and second voltage supplying units are coupled to the string and the driver over a first and a second bus.

4. The lighting system according to claim 1, wherein an additional power converter is coupled between the first and the second voltage supplying unit, preferably between the first and the second bus.

5. The lighting system according to claim 4, wherein the additional power converter is a capacitive converter.

6. The lighting system according to claim 1, wherein the driver is provided with a first, a second and a third terminal.

7. The lighting system according to claim 1, wherein the first voltage supplying unit acts as a voltage source and the second voltage supplying unit acts as a power sink for the driver.

8. The lighting system according to claim 7, wherein the driver is embodied as a switch mode converter, preferably in a switch mode buck driver configuration.

9. The lighting system according to claim 7, wherein the second voltage supplying unit further acts as a power source for a further load.

10. The lighting system according to claim 1, wherein the second voltage supplying unit is a locally present unit and the driver comprises a linear regulator.

11. The lighting system according to claim 1, wherein:

a plurality of strings is present, each of which strings is provided with a driver driving a current through the string and is provided with a terminal coupled to the first voltage supplying unit, each of said driver being provided with a terminal coupled to the second voltage supplying unit.

12. The lighting system according to claim 11, wherein at least part of the driver is integrated into a monolithic integrated circuit.

13. The lighting system according to claim 11, wherein a controller is present for controlling the first supply voltage such that the first supply voltage is at most 150% of a forward voltage of any of the strings.

14. The lighting system according to claim 13, wherein a feedback loop is present between the strings and the controller of the first supply voltage.

15. The lighting system according to claim 1, the second supply voltage is controlled such that the off-state leakage current is controlled.

16. The lighting system according to claim 1, wherein a frequency control for non-fixed conversion frequency converters is performed by controlling the first and/or second supply voltages.

17. Driver integrated circuit comprising:

at least one driver for driving a predetermined current through a string comprising at least one light emitting semiconductor device, a first voltage supplying unit for providing a first supply voltage unequal to ground for driving the string, and a second voltage supplying unit for providing a second supply voltage unequal to ground for driving the string, wherein the first and second voltage supplying units are coupled to the driver in an arrangement, such that a voltage drop across the driver is dependent on the first supply voltage and on second supply voltage.

18. Method for driving a string of at least one light emitting device, comprising:

driving a predetermined current through the string, providing a first supply voltage unequal to ground for driving the string, providing a second supply voltage unequal to ground for driving the string, and selecting the first and second supply voltages to optimize the voltage drop across the driver.

19. The lighting system according to claim 1, wherein the voltage drop across the driver is a combination of the first voltage supply and the second voltage supply.

20. The lighting system according to claim 1, wherein the voltage drop across the driver is equal to the difference between the first supply voltage and the second supply voltage.

* * * * *